US006167736B1

(12) United States Patent
Shore

(10) Patent No.: US 6,167,736 B1
(45) Date of Patent: Jan. 2, 2001

(54) TENSION CONTROL SYSTEM AND METHOD FOR REDUCING FRONT END AND TAIL END OVERFILL OF A CONTINUOUSLY HOT ROLLED PRODUCT

(75) Inventor: T. Michael Shore, Princeton, MA (US)

(73) Assignee: Morgan Construction Company, Worcester, MA (US)

( * ) Notice: Under 35 U.S.C. 154(b), the term of this patent shall be extended for 0 days.

(21) Appl. No.: 09/348,423

(22) Filed: Jul. 7, 1999

(51) Int. Cl.[7] ..... B21B 37/72

(52) U.S. Cl. ..... 72/11.5; 72/8.8; 72/12.5; 72/205; 72/365.2

(58) Field of Search ..... 72/7.5, 8.8, 10.3, 72/11.5, 12.5, 205, 365.2

(56) References Cited

U.S. PATENT DOCUMENTS

| | | | | |
|---|---|---|---|---|
| 3,151,508 | * | 10/1964 | Holman et al. | 72/8.8 |
| 4,002,048 | * | 1/1977 | Pozsgay | 72/205 |
| 4,238,946 | | 12/1980 | Tsubota . | |
| 4,292,825 | | 10/1981 | Morooka et al. . | |
| 4,306,440 | * | 12/1981 | Demny | 72/205 |
| 4,344,309 | | 8/1982 | Matsuzaki . | |
| 4,392,371 | | 7/1983 | Okumura et al. . | |
| 4,593,551 | | 6/1986 | Otto, Jr. et al. . | |
| 4,656,856 | * | 4/1987 | Voye, Jr. | 72/11.5 |
| 4,706,479 | * | 11/1987 | Tominaga | 72/10.3 |
| 4,730,475 | | 3/1988 | Ginzburg . | |
| 4,735,116 | | 4/1988 | Ginzburg . | |
| 4,998,427 | | 3/1991 | Peterson et al. . | |
| 5,142,891 | | 9/1992 | Kuwano . | |

FOREIGN PATENT DOCUMENTS

| | | | | |
|---|---|---|---|---|
| 60-184414 | * | 9/1985 | (JP) | 72/8.8 |
| 2-37910 | * | 2/1990 | (JP) | 72/12.5 |

* cited by examiner

*Primary Examiner*—Ed Tolan
(74) *Attorney, Agent, or Firm*—Samuels, Gauthier & Stevens

(57) ABSTRACT

A system for controlling front and tail end gauge of a continuous hot rolled product in a rolling mill includes first and second individually driven roll stands arranged successively along said pass line in advance of a group of roll stands. A controller adjusts the operating speed relationship between the first and second individually driven roll stands to achieve an increased level of tension in the front and tail end segments of the product passing between the first and second individually driven roll stands. The increased level of tension results in the decrease in product cross sectional area sufficient to compensate for the lack of cross sectional area reduction resulting from the absence of interstand tension experienced by said front and tail end segments while being rolled in the group of roll stands. To control the gauge of the front end of the continuous hot rolled product, the controller commands a decrease in the speed of the first roll stand as front end approaches the second individually driven roll stand, which is located adjacent to and downstream of the first individually driven roll stand. The reduction of the speed of the first roll stand below a nominal rolling speed establishes the increased level of tension of the product between the first and second roll stands when the front end enters the second roll stand. When the front end has passed the first roll stand, the controller commands the speed of the first roll stand to return to the nominal roll speed to roll the segment of the product between the front and tail ends. To control the gauge of the tail end of the product, the controller commands a decrease in the speed of the first roll stand as the tail end approaches the second individually driven roll stand.

16 Claims, 1 Drawing Sheet

TENSION CONTROL SYSTEM AND METHOD FOR REDUCING FRONT END AND TAIL END OVERFILL OF A CONTINUOUSLY HOT ROLLED PRODUCT

BACKGROUND OF THE INVENTION

The invention relates generally to hot rolling of rod and bar products, and in particular to the avoidance of off gauge front (i.e., head) and tail ends.

In a conventional rolling mill, product is directed through a series of roll stands designed to roll alternating oval "O" and round "R" cross sections. The rolls are driven in a manner that ensures the product is maintained in a state of tension as a result of its being pulled forwardly through each successive roll pass. This tension affects the cross section of the product by "necking it down". However, the front and tail ends of the product experience tension free rolling as they pass through the successive roll stands. Thus, the resulting product has oversized front and tail ends. These must be cropped and discarded, thus representing a loss of production. Moreover, these off sized front and tail ends cause increased wear of the guides and other associated equipment in the mill.

Therefore, there is a need for a technique for eliminating the off gauge front end and tail ends of continuously hot rolled products.

SUMMARY OF THE INVENTION

Briefly, according to the present invention, a system for controlling the front and tail end cross sectional area of a continuously hot rolled product in a rolling mill includes first and second individually driven roll stands arranged successively along a pass line in advance of a downstream group of roll stands. A controller adjusts the operating speed relationship between the first and second roll stands to achieve an increased level of tension in the front and tail end segments of the product passing between the first and second individually driven roll stands. The increased level of tension produces an anticipatory decrease in product cross sectional area sufficient to compensate for the lack of cross sectional area reduction resulting from the absence of interstand tension experienced by the front and tail end segments while being rolled in the group of roll stands.

To control the cross sectional area of the front end of the continuously hot rolled product, the controller commands a decrease in the speed of the first roll stand as the front end approaches the second individually driven roll stand, which is located adjacent to and downstream of the first individually driven roll stand. The speed reduction establishes the increased level of tension in the product segment between the first and second roll stands, when the front end enters the second roll stand. When the front end has passed the first roll stand, the controller commands the speed of the first roll stand to return to nominal speed to roll the product length between the front and tail end segments.

To control the cross sectional area of the product tail end, the controller commands a decrease in the speed of the first roll stand as the tail end approaches the second individually driven roll stand. The reduction of the speed of the first roll stand establishes the increased level of tension of the product between the first and second roll stands when the tail end enters the second roll stand. That is, the controller anticipates the arrival of the lengthwise ends at the second individually driven roll stand and decreases the speed of the first roll stand in a controlled manner to establish a desired tension in the segment between the first and second roll stands.

Advantageously, applying an anticipatory increase in interstand tension to the end segments of the continuously hot rolled product controls the cross sectional area of the front end and tail end of the product to minimize and optimally eliminate any necessity for front and tail cropping.

These and other objects, features and advantages of the present invention will become more apparent in light of the following detailed description of preferred embodiments thereof, as illustrated in the accompanying drawings.

BRIEF DESCRIPTION OF THE DRAWING

The single FIGURE is a block diagram illustration of a portion of a rolling mill according to the present invention.

DETAILED DESCRIPTION OF THE INVENTION

Figure 1:
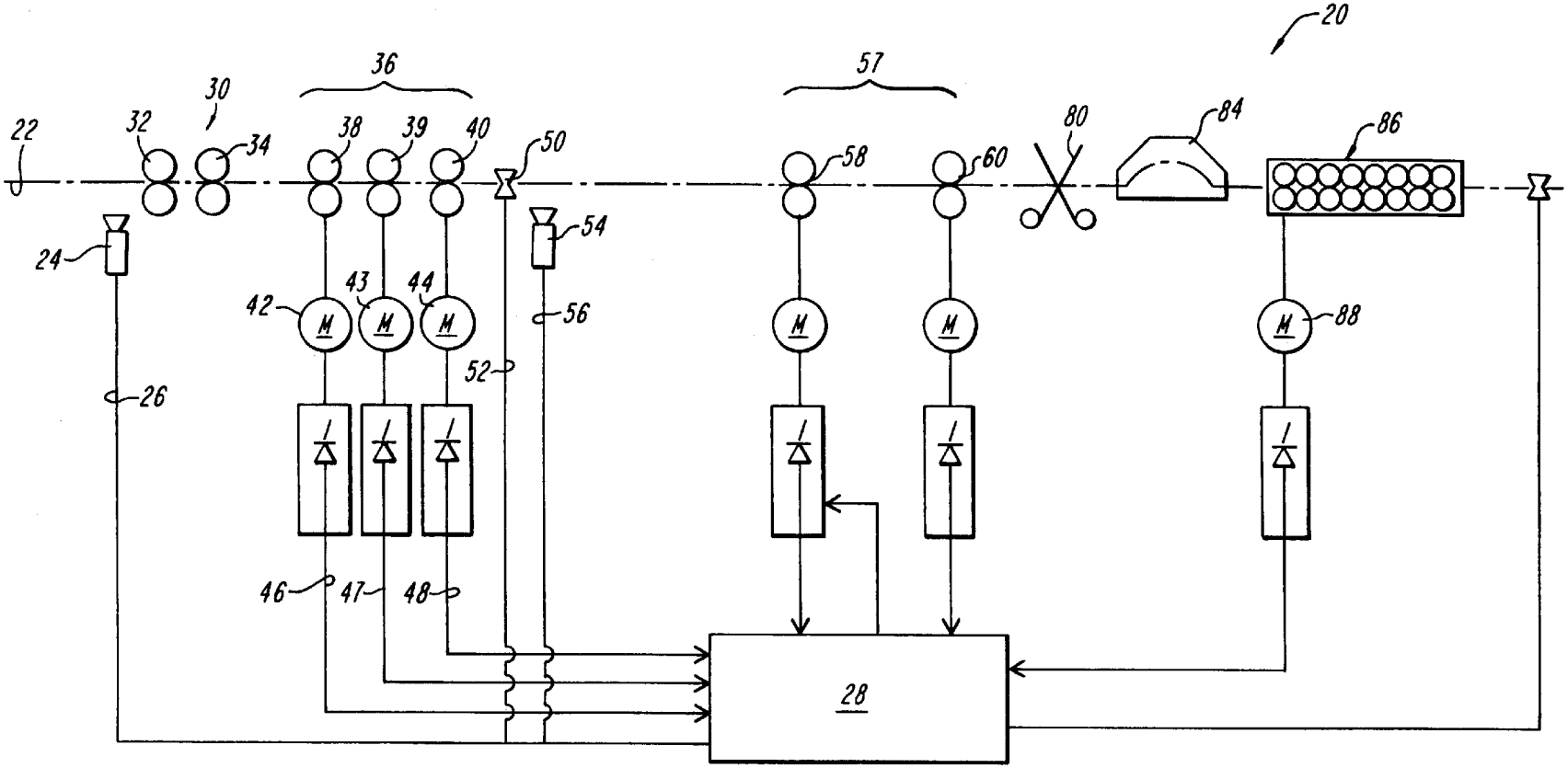

The Figure is a block diagram illustration of a portion of a continuous hot rolling mill 20 that rolls product along a pass line 22. A first hot metal detector 24 detects the presence/absence of product along the pass line 22 and provides a signal indicative thereof on a line 26 to a controller 28. In this portion of the rolling mill the product enters a roughing mill 30 comprising several adjacent rolling stands 32, 34 which operate on the product in a known manner. Downstream of the roughing mill 30 is an intermediate mill 36 that also includes a plurality of successive roll stands 38–40 to further reduce the cross sectional area of the product. Intermediate mill roll stands 38–40 are driven by variable speed motors 42–44 respectively, both under the control of the controller 28. The variable speed motors 42–44 provide feedback signals on lines 46–48 respectively to the controller indicative of load on the motors for motor speed control and product tracking. Although only three roll stands are shown for the purposes of illustration, one of ordinary skill will recognize that the intermediate mill 36 may include more stands depending on the overall mill design.

A gauge sensor 50 measures the gauge of the rolled product exiting the intermediate mill 36, and provides a measured gauge signal on a line 52 to the controller 28. A second hot metal detector 54 detects the presence/absence of product at the outlet of the intermediate mill and provides a signal indicative of the product presence/absence to the controller on a line 56 for product tracking purposes.

According to the present invention, the mill 20 includes a prefinishing mill 57 comprising first and second individually driven roll stands 58, 60 arranged successively along the pass line. The controller 28 adjusts the operating speed relationship between the first and second roll stands to achieve an increased level of tension in the front and tail end segments of the product passing between the first and second individually driven roll stands 58, 60. The increased level of tension results in an anticipatory decrease in product cross sectional area that is sufficient to compensate for the lack of cross sectional area reduction due to the absence of interstand tension experienced by the front and tail end segments during rolling downstream of the prefinishing mill 57.

To control the cross sectional area of the front end of the continuous hot rolled product, in one embodiment the controller 28 commands a decrease in the speed of the first roll stand 58 as the product front end approaches the second individually driven roll stand 60, which is located adjacent to and downstream of the first individually driven roll stand 58. The approach is sensed by the hot metal detector 54, which is located a known distance from the second individually driven roll stand 60, and the motor load signals.

Since the speed of the product is known, the time of arrival of the front end at the second individually driven roll stand is also known. The reduction of the speed of the first roll stand 58 below a nominal rolling speed establishes the increased level of tension of the product between the first and second roll stands when the front end enters the second roll stand 60. The amount of tension is a function of the difference in speed between the first and second individually driven roll stands 58, 60. When the front end has passed through the first roll stand 58, the controller 28 commands the speed of the first roll stand to return to nominal speed to roll the segment of the product between the front and tail ends.

The length of the front end and the tail end to be rolled according to the present invention by the prefinishing mill 57 is determined as a function of the length ($S_2$) of the back fill of the finished product exiting the laying head, and the product speed ($V_1$) at the input to the prefinishing mill 57 and the output speed ($V_2$) at the final rolling stand of the mill. For example, since the length ($S_2$) of the back fill of the finished product exiting the laying head is known, the length ($S_1$) of the front end and the tail end to which the increased level of tension will be applied is approximately $S_1=S_2 * (V_1/V_2)$. However, it is contemplated that the exact distance will be derived empirically based upon this approximation.

It is also contemplated that the reduced speed value will be derived empirically based upon the individual characteristics of the mill employing the tension control system of the present invention. For example, the reduced speed value may be selected based upon the specific product size that is being rolled, the amount of tension required to achieve the desired cross sectional area in that product and the characteristics of the rolls within the stands 58, 60. In addition, the gauge sensor(s) may provide product gauge characteristics to the controller to further adjust the reduced speed value. However, in any event one of ordinary skill in the art will recognize that the reduced speed value is simply selected to provide an increased level of tension in the front and tail end segments of the product passing between the first and second individually driven roll stands in order to achieve a desired front end and tail end cross sectional area.

To control the cross sectional area of the product tail end, the controller commands a decrease in the speed of the first roll stand as the tail end approaches the second individually driven roll stand 60. The speed reduction establishes the increased level of tension on the product between the first and second roll stands when the tail end enters the second roll stand. Specifically, the desired tail cross sectional area is realized by reducing the speed on the first roll stand to establish a tension causing the tail end to take the desired cross sectional area. Again the reduced speed value is selected based upon the tension required.

Notably, the resultant product includes a front end and a tail end of reduced cross sectional area in comparison to product segment between the front and tail ends. Therefore, the product leaving the prefinishing mill 57 is provided with front and tail end segments having reduced cross sectional areas. The thus configured product proceeds through a shear 80 and looping device 84 for final rolling in a finishing block 86 having a plurality of successive roll pairs mechanically interconnected and driven by a common drive 88. The shear 80 operates to crop any front and tail end segment that have not been anticipatorily reduced in cross section in the prefinishing mill 57 and/or that are otherwise required to be removed because they are unsatisfactory from a metallurgical standpoint. The finishing block 86 is preferably a NO-TWIST® mill supplied by the Morgan Construction Company of Worcester, Mass., USA (the assignee of the present invention), for example as described in the U.S. Pat. No. 4,537,055 the disclosure of which is herein incorporated by reference. The speed relationship, between the roll pairs within the finishing block 86 is fixed, as is the level of tension in the product passing therebetween. Thus, the front and tail end segments of the product will be subjected to tension-free rolling, which but for the anticipatory decrease in cross sectional area effected in the prefinishing mill 57, would result in off gauge product. However, the anticipatory decrease in cross sectional areas performed by the prefinishing mill 57 compensates for the lack of tension in the front and tail end segments, resulting in a finished product which is dimensionally acceptable from end to end, thereby eliminating the need for front and tail end cropping.

The controller 28 preferably includes a microprocessor (not shown) which executes programmable software routines to control the system according to the present invention.

Although the present invention has been discussed in the context of providing an increased level of tension by decreasing the speed of the first individually driven roll stand, in an alternative embodiment the increased level of tension may also be provided by increasing the speed of the second individually driven roll stand. In addition, it is contemplated that the approach of the front end and the tail end to the second individually driven roll stand may also use the motor load signals, in addition to the signals from the hot metal detectors and the known speeds of the product at various positions within the mill. Also, even though a single controller is illustrated, several controllers may be used depending upon how the mill control tasks are partitioned.

The tension control system of the present invention ideally eliminates the off gauge front and tail ends, and thus increases mill yield/efficiency.

Although the present invention has been shown and described with respect to several preferred embodiments thereof, various changes, omissions and additions to the form and detail thereof, may be made therein, without departing from the spirit and scope of the invention.

What is claimed is:

1. In a rolling mill wherein a product of finite length is rolled continuously in a group of roll stands arranged successively along a pass line, with all but a front end segment and a tail end segment of said product being subjected to tension between successive roll stands in said group, thereby resulting in said front and tail end segments having cross sectional areas that are larger than the cross sectional area of the remainder of said product, a method of equalizing the cross sectional area of said product over a substantial portion of its length, comprising the steps of:

providing first and second roll stands separately driven at rotational speeds and arranged successively along said pass line in advance of said group of roll stands; and anticipatorily adjusting the rotational speed of least one of said first and second roll stands to achieve an increased level of tension in the front and tail end segments passing therebetween, with the result that said front and tail end segments have reduced cross sectional area that are smaller than the cross sectional area of the remainder of said product, said reduced cross sectional areas being sufficient to compensate for subsequent inadequate cross sectional area reduction resulting from an absence of interstand tension experienced by said front and tail end segments while being rolled in said group of roll stands.

2. The method of claim 1, wherein said first roll stand is located upstream in the rolling mill relative to the second roll stand, and said step of adjusting comprises the step of:

sensing approach of the front end to said second roll stand and in response decreasing the speed of said first roll stand to increase the tension on the front end as it passes between said first and second roll stands.

3. The method of claim 1, wherein said step of adjusting comprises the step of:

sensing approach of the tail end to said second roll stand and in response decreasing the speed of said first roll stand to increase the tension on the tail end as it passes between said first and second roll stands.

4. The method of claim 1, wherein said first roll stand is located upstream in the rolling mill relative to the second roll stand, and said step of adjusting comprises the steps of:

sensing approach of the front end to said second roll stand and in response decreasing the speed of said first roll stand to increase the tension on the front end as it passes between said first and second roll stands; and sensing approach of the tail end to said second roll stand and in response decreasing the speed of said first roll stand to increase the tension on the tail end as it passes between said first and second roll stands.

5. The method of claim 2, wherein said step of decreasing the speed comprises the steps of:

selecting a reduced speed value as a function of the type of product being rolled and a desired cross sectional area of said front end; and commanding the first roll stand to said reduced speed value.

6. The method of claim 2, wherein said step of sensing comprises the steps of:

monitoring a hot metal detector located a known distance from the first roll stand.

7. The method of claim 1, wherein said first roll stand is located upstream in the rolling mill relative to the second roll stand, and said step of adjusting comprises the steps of:

sensing approach of the front end to said second roll stand and in response increasing the speed of said second roll stand to increase the tension on the front end as it passes between said first and second roll stands.

8. The method of claim 1, wherein said step of adjusting comprises the steps of:

sensing approach of the tail end to said second roll stand and in response increasing the speed of said second roll stand to increase the tension on the tail end as it passes between said first and second roll stands.

9. The method of claim 1, wherein said first roll stand is located upstream in the rolling mill relative to the second roll stand, and said step of adjusting comprises the steps of:

sensing approach of the front end to said second roll stand and in response increasing the speed of said second roll stand to increase the tension on the front end as it passes between said first and second roll stands; and sensing approach of the tail end to said second roll stand and in response increasing the speed of said second roll stand to increase the tension on the tail end as it passes between said first and second roll stands.

10. A system for controlling the cross sectional area of front and tail ends of a continuously hot rolled product in a rolling mill, said system comprising:

a first roll stand;

a second roll stand, wherein said first and second roll stands are aligned with a pass line along which the continuous hot rolled product travels, and said first and second roll stands are separately driven;

means for sensing position of the front end and the tail end within the rolling mill and providing a position signal indicative thereof; and a controller responsive to said position signal to control the speed of said first and second roll stands to selectively apply an increased level of tension to the front end and tail end of the rolled product while between said first and second roll stands to achieve a desired front end and tail end cross sectional area, which is smaller than the cross sectional area of the product between the front and tail ends.

11. The system of claim 10, wherein said controller comprises:

means responsive to said position signal, for detecting the approach of said front end to said second roll stand and for providing a front end trigger signal indicative thereof, and for determining when said tail end has exited said first roll stand;

means responsive to said front end trigger signal for decreasing the speed of said first roll stand; and means responsive to said tail end exiting said first roll stand for increasing the speed of said second roll stand.

12. The system of claim 10, wherein said controller comprises a microprocessor.

13. The system of claim 10, wherein said means for sensing the position of the front end and the tail end within said rolling mill and providing a position signal indicative thereof comprises a hot metal detector that is located known distances upstream of said first and second roll stands.

14. The system of claim 10, wherein said controller comprises:

means for selectively applying the increased level of tension to the front end and tail end of the rolled product while between said first and second roll stands by decreasing the speed of said first roll stand.

15. The system of claim 10, wherein said controller comprises:

means for selectively applying the increased level of tension to the front end and tail end of the rolled product while between said first and second roll stands by increasing the speed of said second roll stand.

16. A system for controlling the cross sectional area of front and tail ends of a continuously hot rolled product in a rolling mill, said system comprising:

a first roll stand;

a second roll stand, wherein said first and second roll stands are aligned with a pass line along which the continuous hot rolled product travels, wherein said first and second roll stands are located upstream of a block of roll stands;

a sensor located upstream of said first and second roll stands to sense passage of the front end and the tail end along the pass line and provide a status signal indicative thereof; and a controller responsive to said status signal to control relative speed of said first and second roll stands to selectively apply an increased level of tension to the front end and tail end of the rolled product while between said first and second roll stands to achieve a desired front end and tail end cross sectional area.

* * * * *